US010830472B2

(12) United States Patent
Hern et al.

(10) Patent No.: US 10,830,472 B2
(45) Date of Patent: Nov. 10, 2020

(54) SYSTEMS AND METHODS FOR DYNAMIC COIL CALIBRATION

(71) Applicant: Johnson Controls Technology Company, Auburn Hills, MI (US)

(72) Inventors: Shawn A. Hern, Derby, KS (US); Tyler P. McCune, El Dorado, KS (US); Aneek M. Noor, Wichita, KS (US); Drew H. Carlton, Wichita, KS (US); Cody J. Kaiser, Wichita, KS (US)

(73) Assignee: Johnson Controls Technology Company, Auburn Hill, MI (US)

( * ) Notice: Subject to any disclaimer, the term of this patent is extended or adjusted under 35 U.S.C. 154(b) by 153 days.

(21) Appl. No.: 16/241,594

(22) Filed: Jan. 7, 2019

(65) Prior Publication Data

US 2020/0200418 A1 Jun. 25, 2020

Related U.S. Application Data

(60) Provisional application No. 62/782,954, filed on Dec. 20, 2018.

(51) Int. Cl.

| | |
|---|---|
| ***F24F 11/43*** | (2018.01) |
| ***F24F 1/0007*** | (2019.01) |
| ***F24F 1/009*** | (2019.01) |
| ***F24F 11/67*** | (2018.01) |

(52) U.S. Cl.

CPC ..... *F24F 11/43* (2018.01); *F24F 1/009* (2019.02); *F24F 1/00073* (2019.02); *F24F 11/67* (2018.01)

(58) Field of Classification Search

CPC ..... F24F 1/00073; F24F 1/009; F24F 11/67; F24F 11/41; F24F 11/42; F24F 11/43; F24F 2110/10; F24F 2110/12; F24F 2110/22; F24F 2110/20

See application file for complete search history.

(56) References Cited

U.S. PATENT DOCUMENTS

| | | | | |
|---|---|---|---|---|
| 5,727,395 | A | 3/1998 | Guo et al. | |
| 5,797,273 | A | 8/1998 | Guo et al. | |
| 6,318,095 | B1 | 11/2001 | Guo et al. | |
| 7,228,692 | B2 | 6/2007 | Concha et al. | |
| 7,992,396 | B2 * | 8/2011 | Thybo | F25B 49/005 62/155 |
| 2003/0140644 | A1 * | 7/2003 | Wightman | F25B 41/04 62/196.4 |

(Continued)

*Primary Examiner* — Kun Kai Ma

(74) *Attorney, Agent, or Firm* — Fletcher Yoder, P.C.

(57) ABSTRACT

Systems and methods are disclosed that calibrate a defrost threshold used to determine when a heating, ventilating, and air conditioning (HVAC) system enters a defrost mode, and, more particularly, determine frost temperature differences used to determine the defrost threshold when the HVAC system is in a stable condition. A frost temperature difference is a difference between an outdoor ambient temperature and a refrigerant temperature. The HVAC system determines that it is in the stable condition by determining that a standard deviation of a current frost temperature difference from a previous frost temperature difference is below a standard deviation threshold. When the HVAC system is in the stable condition, the frost temperature differences are determined, and the defrost threshold is determined from the frost temperature differences.

20 Claims, 7 Drawing Sheets

(56) References Cited

U.S. PATENT DOCUMENTS

| | | | | |
|---|---|---|---|---|
| 2005/0257564 | A1* | 11/2005 | Wightman | F25B 41/04 62/510 |
| 2007/0295015 | A1* | 12/2007 | Bailey | F25D 21/006 62/150 |
| 2015/0219356 | A1* | 8/2015 | Ito | F24F 11/30 165/237 |
| 2016/0238301 | A1 | 8/2016 | Denton | |
| 2017/0176072 | A1 | 6/2017 | Gokhale et al. | |
| 2018/0340719 | A1* | 11/2018 | Rona | F25B 49/02 |

* cited by examiner

SYSTEMS AND METHODS FOR DYNAMIC COIL CALIBRATION

CROSS REFERENCE TO RELATED APPLICATION

This application claims the benefit of U.S. Provisional Application No. 62/782,954, entitled "Systems and Methods for Dynamic Coil Calibration," filed Dec. 20, 2018, which is hereby incorporated by reference in its entirety for all purposes.

BACKGROUND

The present disclosure generally relates to a heating, ventilating, and air conditioning (HVAC) system and, more particularly, to defrosting an outdoor refrigerant coil of the HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An HVAC system typically controls air conditions, such as temperature and/or humidity, within a building. The HVAC system may include an outdoor refrigerant coil that exchanges heat between refrigerant in the outdoor coil and the outdoor ambient environment. However, in some instances, due to colder outdoor temperatures, such as freezing or below freezing temperatures, frost and/or ice may form on the outdoor coil, reducing the effectiveness of the conditioned air system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system at least partially located in an ambient environment includes a coil that transmits refrigerant therethrough. The HVAC system also includes a first sensor that detects a refrigerant characteristic in the refrigerant transmitted through the coil, and a second sensor that detects an ambient characteristic of the ambient environment. The HVAC system further includes a controller that receives a first refrigerant characteristic value and a second refrigerant characteristic value from the first sensor. The controller also receives a first ambient characteristic value and a second ambient characteristic value from the second sensor. The first refrigerant characteristic value is correlated to the first ambient characteristic value and the second refrigerant characteristic value is correlated to the second ambient characteristic value. The controller further determines a first temperature difference value based on the first refrigerant characteristic value and the first ambient characteristic value. The controller also determines a standard deviation based on the first temperature difference value and a set of other refrigerant characteristic values and other ambient characteristic values. The controller further determines a defrost threshold based on the first temperature difference value in response to determining that the standard deviation is less than a standard deviation threshold. The controller also operates the coil in a defrost mode in response to determining that a second temperature difference value based on the second refrigerant characteristic value and the second ambient characteristic value exceeds the defrost threshold.

In another embodiment, a controller of an HVAC system includes a memory device and a processor. The memory device includes instructions for operating the HVAC system. The processor, when executing the instructions, receives refrigerant temperatures, receives outdoor ambient temperatures, and determines frost temperature differences based on the refrigerant temperatures and the outdoor ambient temperatures. The processor also determines standard deviations based on the frost temperature differences, and determines a defrost threshold based on the frost temperature differences in response to determining that a standard deviation is less than a standard deviation threshold. The processor further after determining the defrost threshold, operates the HVAC system in a defrost mode in response to determining that a frost temperature difference exceeds the defrost threshold.

In yet another embodiment, a method that calibrates an active defrost threshold that is used by an HVAC system to enter a defrost mode in response to a frost temperature difference exceeding the active defrost threshold. The frost temperature difference is a difference between a refrigerant temperature and an outdoor ambient temperature. The method includes receiving information associated with the outdoor ambient temperature and the refrigerant temperature, determining a measured frost temperature difference based on the outdoor ambient temperature and the refrigerant temperature, and determining a standard deviation based on the measured frost temperature difference. The method also includes determining the active defrost threshold based on the measured frost temperature difference and the standard deviation.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
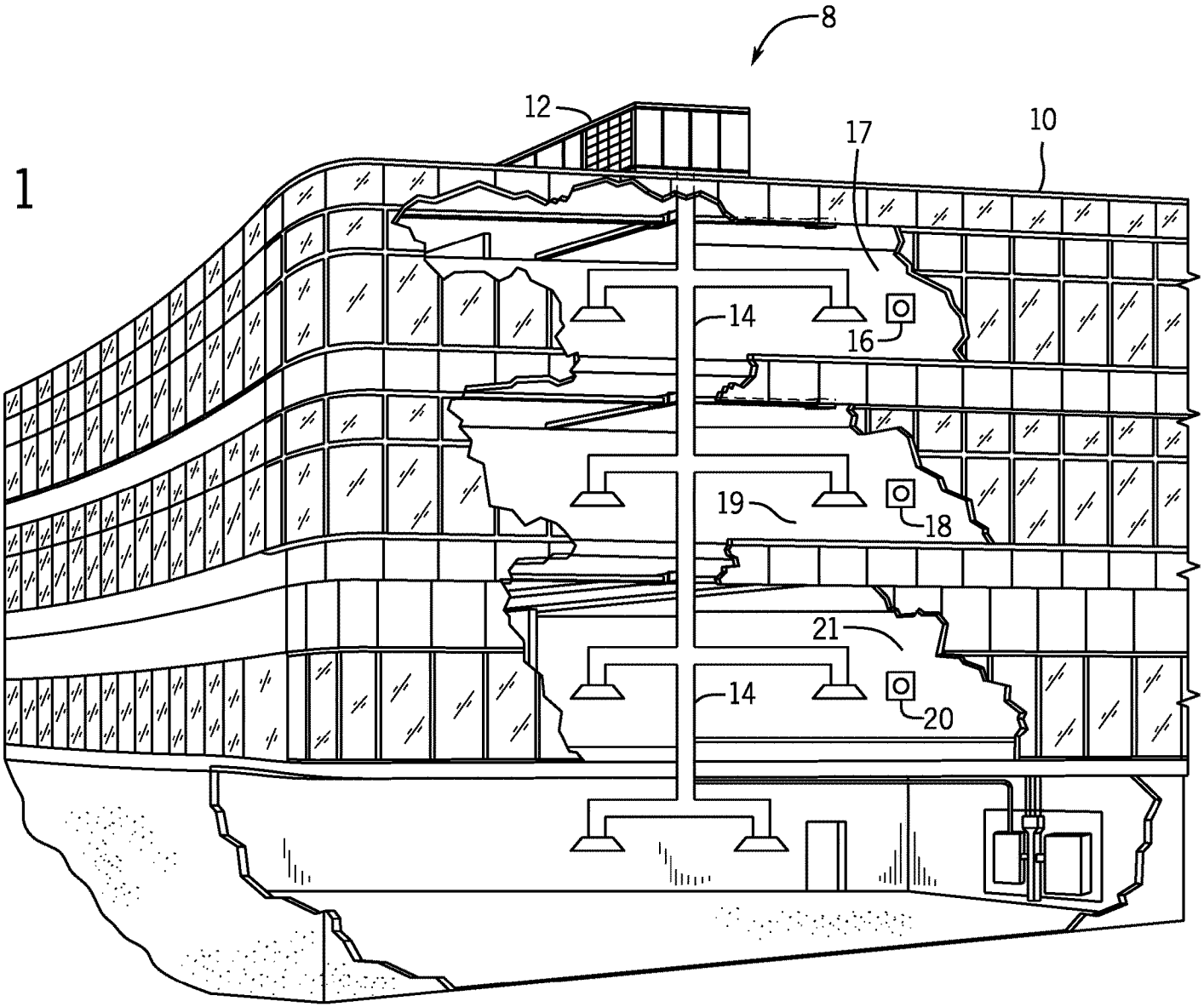
FIG. 1 illustrates a heating, ventilating, and air conditioning (HVAC) system for building environmental management that may employ one or more HVAC units, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

Generally, a heating, ventilating, and air conditioning (HVAC) system may control air conditions, such as temperature and/or humidity, within a building. The HVAC system may include an outdoor refrigerant coil that exchanges heat between refrigerant in the outdoor coil and the outdoor ambient environment. However, due to colder outdoor temperatures, such as freezing or below freezing temperatures, frost and/or ice may form on the outdoor coil, reducing capacity and/or performance of the HVAC system. It should be understood that the outdoor coil may not necessarily be placed outdoors or outside, and may be placed in any suitable location that enables the outdoor coil to transfer heat between the refrigerant and an ambient environment.

The HVAC system may determine that frost and/or ice has formed on the outdoor coil based on certain information, such as sensor information from a refrigerant temperature or pressure sensor and/or an outdoor ambient temperature sensor. In particular, the HVAC system may determine a frost temperature difference between the outdoor ambient temperature and the refrigerant temperature based on the sensor information, and determine whether the frost temperature difference exceeds a defrost threshold. If so, the HVAC system may switch from a normal operating mode, such as a heating mode where the outdoor coil acts as an evaporator transferring heat from the outdoor ambient air, to a defrost mode to send warm refrigerant to the outdoor coil to melt or thaw out the frost and/or ice formed on the outdoor coil. Once the HVAC system determines that the outdoor coil is sufficiently free of frost and/or ice, the HVAC system may return to its previous normal operating mode, such as the heating mode, or another normal operating mode.

After returning to the normal operating mode, the HVAC system may calibrate the defrost threshold used to determine whether frost and/or ice has formed on the outdoor coil. The defrost threshold may be determined based on one or more frost temperature differences determined after the HVAC system returns from the defrost mode. A frost temperature difference may be defined as a difference between the refrigerant temperature and the outdoor ambient temperature. Determining the one or more frost temperature differences at certain times may result in inaccurately characterizing when frost and/or ice has formed on the outdoor coil. For example, if the outdoor coil is not in a stable condition, such that HVAC system pressures and temperatures are still transitioning, then sensor information associated with the refrigerant temperature, as measured at the outdoor coil, may include greater variation, resulting in an inaccurate frost temperature difference determination. Operating the HVAC system with an inaccurate frost temperature difference may cause a less effective application of the defrost mode of the HVAC system, ultimately resulting in a less efficient HVAC system.

Accordingly, the present disclosure provides systems and methods that calibrate the defrost threshold used to determine when the HVAC system enters the defrost mode, and, more particularly, determine the one or more frost temperature differences used to determine the defrost threshold when the HVAC system is in a stable condition. The HVAC system may determine whether it is in the stable condition by, for example, determining that a standard deviation of a current frost temperature difference from a previous frost temperature difference is below a standard deviation threshold. When it is determined that the HVAC system is in the stable condition, the one or more frost temperature differences may be determined, and the defrost threshold may be determined from the one or more frost temperature differences. The defrost threshold may be more accurate in characterizing when frost and/or ice has formed on the outdoor coil than a defrost threshold determined when the HVAC system is not in the stable condition. The HVAC system may then compare subsequent frost temperature differences to the defrost threshold to more accurately determine when frost and/or ice has formed on the outdoor coil, resulting in more efficient and effective operation.

Turning now to the drawings, FIG. 1 illustrates a conditioned air system 8, such as a heating, ventilating, and air conditioning (HVAC) system, for building environmental management that may employ one or more HVAC units. In the illustrated embodiment, a building 10 is air conditioned by the conditioned air system 8 that includes a conditioned air unit or HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may include a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

In any case, the HVAC unit 12 may be an air cooled device that implements a refrigeration cycle to provide conditioned air to the building 10. For example, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the air is conditioned, the HVAC unit 12 may supply the conditioned air to the building 10 via ductwork 14 extending throughout the building 10 from the HVAC unit 12. For example, the ductwork 14 may extend to various individual floors or other sections of the building 10. In some embodiments, the HVAC unit 12 may include a heat pump that provides both heating and cooling to the building 10, for example, with one refrigeration circuit implemented to operate in multiple different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other equipment, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and/or the like. Moreover, the control device 16 may include computer systems that are integrated with or separate from other building control or monitoring systems, and even systems that are remote from the building 10. In some embodiments, the HVAC unit 12 may be operate in multiple zones of the building, and be coupled to multiple control devices that each control flow of air in a respective zone. For example, a first control device 16 may control the flow of air in a first zone 17 of the building, a second control device 18 may control the flow of air in a second zone 19 of the building, and a third control device 20 may control the flow of air in a third zone 21 of the building.

Figure 2:
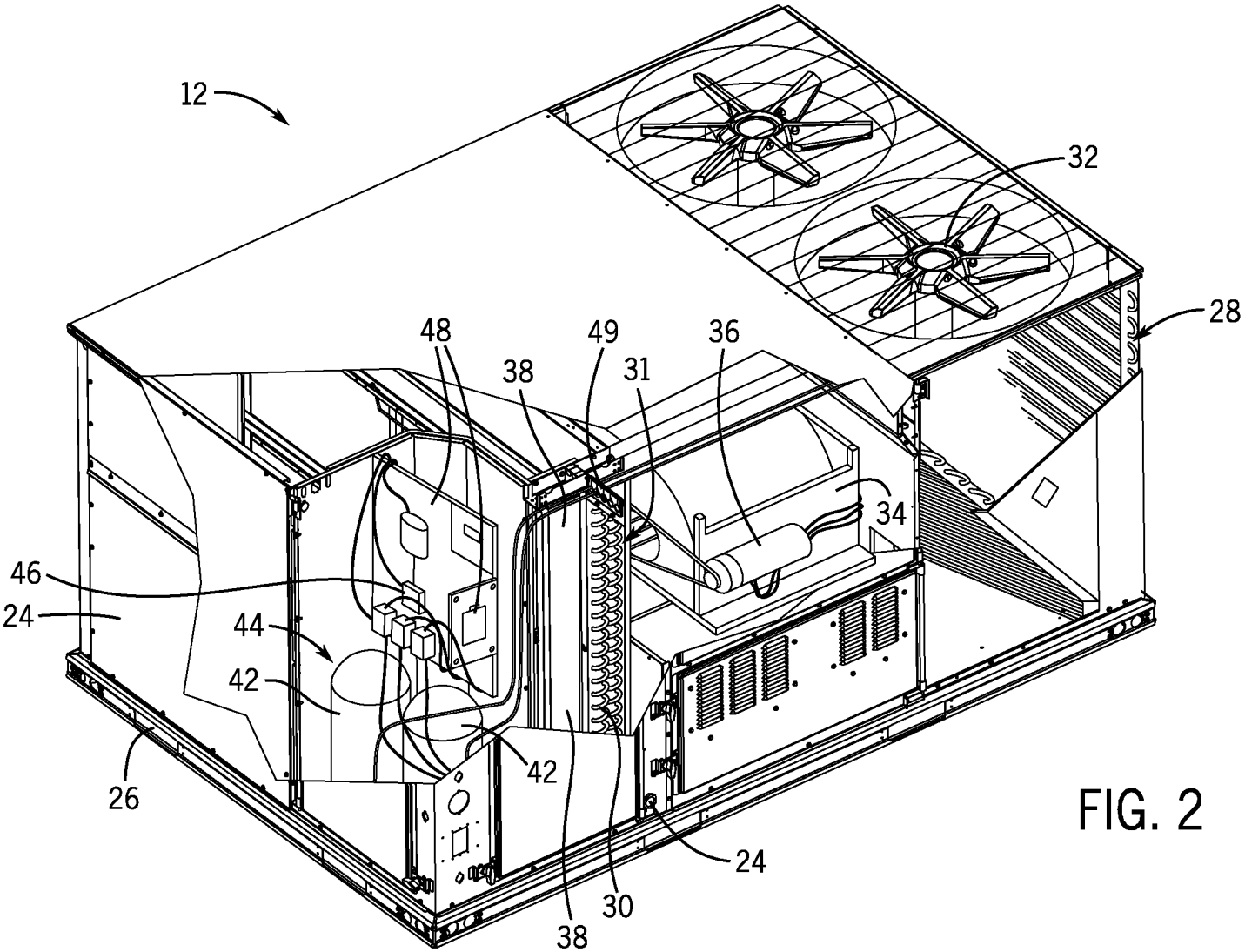
FIG. 2 is a perspective view of a HVAC unit of the HVAC system of FIG. 1, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, and/or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12, for example, to provide structural support and/or protect the internal components from environmental contaminant and/or other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and/or the like. Together, the heat exchangers 28 and 30 may implement a thermal cycle in which the refrigerant undergoes phase changes and/or temperature changes as it flows through the heat exchangers 28 and 30 to produce heated and/or cooled air.

For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 may draw air from the environment through the heat exchanger 28. As it flows through the heat exchanger 28, air may be heated or cooled before being released back to the environment surrounding the rooftop unit 12. A blower assembly 34, powered by a motor 36, may draw air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to reduce likelihood of contaminants contacting the heat exchanger 30.

The HVAC unit 12 also may include other equipment for implementing the thermal cycle. Compressors 42 may increase the pressure and/or temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and/or devices may be included in the HVAC unit 12, such as a solid-core filter drier, a drain pan, a disconnect switch, an economizer, pressure switches, phase monitors, and humidity sensors, among other things.

The HVAC unit 12 may receive electrical power via a terminal block 46. For example, a high voltage power source may be connected to the terminal block 46 to power the equipment. The operation of the HVAC unit 12 may be governed or regulated by a control board 48. The control board 48 may include control circuitry connected to a thermostat, a sensor, and/or an alarm. One or more of these components may be referred to herein separately or collectively as the control device 16. The control circuitry may control operation of the equipment, provide alarms, and/or monitor safety switches. Wiring 49 may connect the control board 48 and the terminal block 46 to the equipment of the HVAC unit 12.

Figure 3:
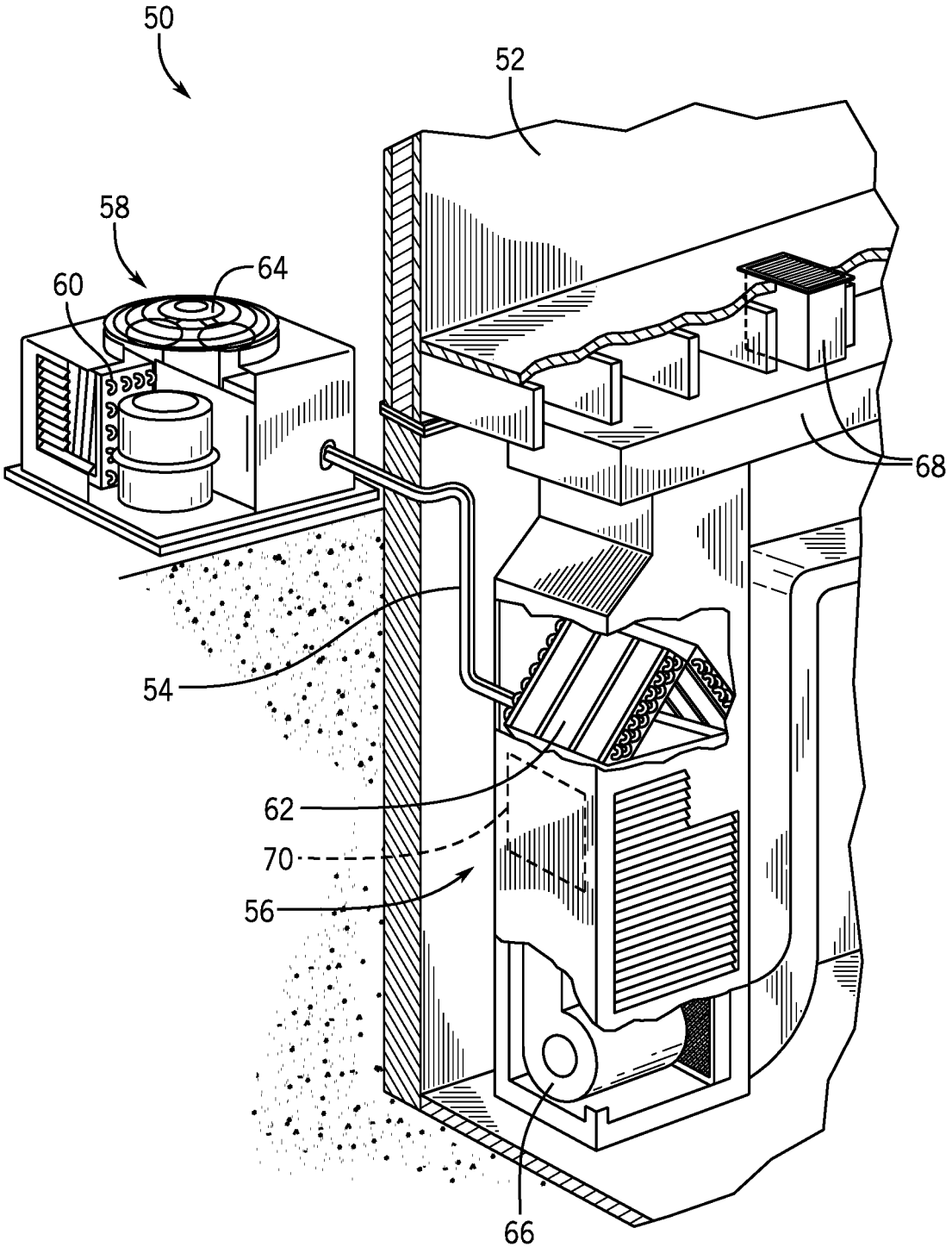
FIG. 3 illustrates a residential heating and cooling system, in accordance with an embodiment of the present disclosure.

FIG. 3 illustrates a residential heating and cooling system 50, also in accordance with present techniques. The residential heating and cooling system 50 may provide heated air to a residential structure, cooled air to a residential structure, ventilation for the residential structure, and/or improved indoor air quality (IAQ) through devices, such as ultraviolet lights and/or air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 may transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 may serve as a condenser for re-condensing vaporized refrigerant flowing from the indoor unit 56 to the outdoor unit 58 via one of the refrigerant conduits 54. In these applications, a heat exchanger 62 of the indoor unit may function as an evaporator. Specifically, the heat exchanger 62 may receive liquid refrigerant, which may be expanded by an expansion device, and evaporate the refrigerant before returning it to the outdoor unit 58.

The outdoor unit 58 may draw environmental air through the heat exchanger 60 using a fan 64 and expels the air above the outdoor unit 58. When operating in an air conditioner mode, the air heated by the heat exchanger 60 within the outdoor unit 58 exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52.

The overall system operates to maintain a desired temperature as set by a system controller. When the temperature sensed inside the residence 52 is higher than the setpoint on the thermostat, or the setpoint plus a small amount, the residential heating and cooling system 50 may become operative to refrigerate or cool additional air for circulation through the residence 52. When the temperature reaches the setpoint, or the setpoint minus a small amount, the residential heating and cooling system 50 may stop the refrigeration cycle temporarily.

The residential heating and cooling system 50 may also operate in a heat pump mode. When operating in the heat pump mode, the roles of heat exchangers 60 and 62 may be reversed. That is, the heat exchanger 60 of the outdoor unit 58 may serve as an evaporator to evaporate refrigerant and thereby cool air entering the outdoor unit 58 as the air passes over outdoor the heat exchanger 60. The indoor heat exchanger 62 may receive a stream of air blown over it and heat the air by condensing the refrigerant.

In some embodiments, the indoor unit 56 may include a furnace system 70. For example, the indoor unit 56 may include the furnace system 70 when the residential heating and cooling system 50 is not implemented to operate as a heat pump. The furnace system 70 may include a burner assembly and heat exchanger, among other components, inside the indoor unit 56. Fuel may be provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
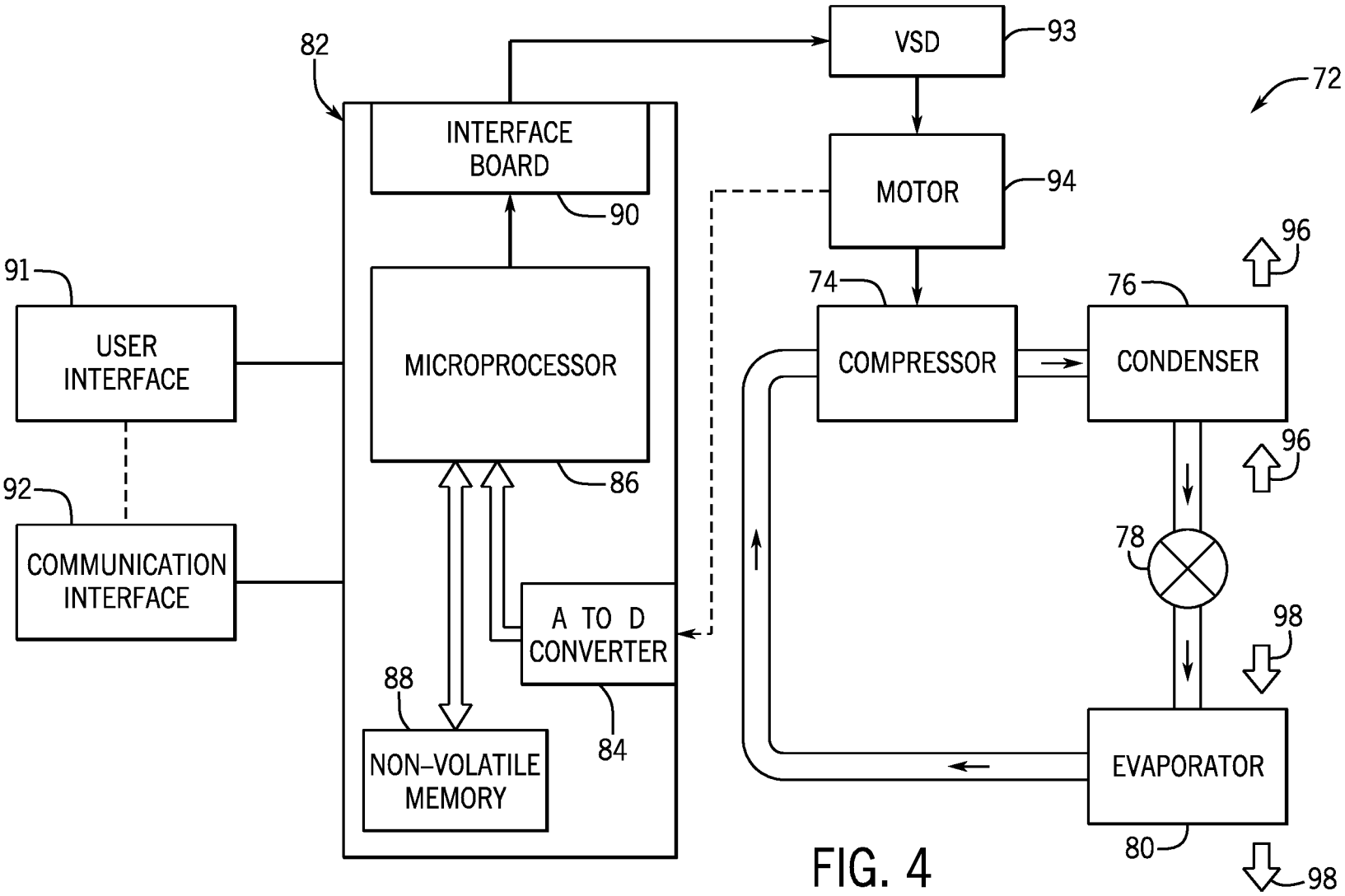
FIG. 4 illustrates a vapor compression system that may be used in the HVAC system of FIG. 1 and in the residential heating and cooling system of FIG. 3, in accordance with an embodiment of the present disclosure.

FIG. 4 is an embodiment of a conditioned air or vapor compression system 72, that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a processor or microprocessor 86, a memory device such as a non-volatile memory 88, and/or an interface board 90.

The control panel 82 and its components may function to regulate operation of the vapor compression system 72 based on feedback from an operator, from sensors of the vapor compression system 72 that detect operating conditions, and so forth. The processor 86 may include any type of processing circuitry, such as one or more processors, one or more "general-purpose" microprocessors, one or more special-purpose microprocessors, and/or one or more application specific integrated circuits (ASICS), or some combination thereof. For example, the processor 86 may include one or more reduced instruction set (RISC) processors.

The control panel 82 may be communicatively coupled to and/or include a user interface 91 that provides information to and/or receives information from a user. The user interface 91 may include any suitable combination of input and output devices, such as an electronic display, a touchscreen, a stylus, a keypad, a button, and/or the like, to enable communicating system fault and/or malfunction information to a user.

In some embodiments, the control panel 82 may be communicatively coupled to and/or include a communication interface 92 that may enable communication with any suitable communication network, such as wiring terminals, a cellular network, a WiFi network, a personal area network (PAN), a local area network (LAN), a wide area network (WAN), and/or the like. For example, the communication interface 92 may enable the control panel 82 to communicate with a user interface 91 implemented on a user's mobile device, which is also communicatively coupled to the communication network.

In some embodiments, the vapor compression system 72 may use one or more of a variable speed drive (VSDs) 93, a motor 94, the compressor 74, the condenser 76, the expansion valve or device 78, and/or the evaporator 80. The motor 94 may drive the compressor 74 and may be powered by the variable speed drive (VSD) 93. The VSD 93 may receive alternating current (AC) power having a particular fixed line voltage and fixed line frequency from an AC power source, and provide power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 may compress a refrigerant vapor and deliver the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant may exit the evaporator 80 and return to the compressor 74 by a suction line to complete the cycle.

In some embodiments, the vapor compression system 72 may further include a reheat coil in addition to the evaporator 80. For example, the reheat coil may be positioned downstream of the evaporator 80 relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC system. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference to FIGS. 1-4 is intended to be illustrative of the context of the present disclosure. The techniques of the present disclosure may update features of the description above. In particular, as will be discussed in more detail below, the present disclosure provides techniques that enable an HVAC system to restore functionality and/or operate at reduced functionality when one or more faults are present.

Figure 5:
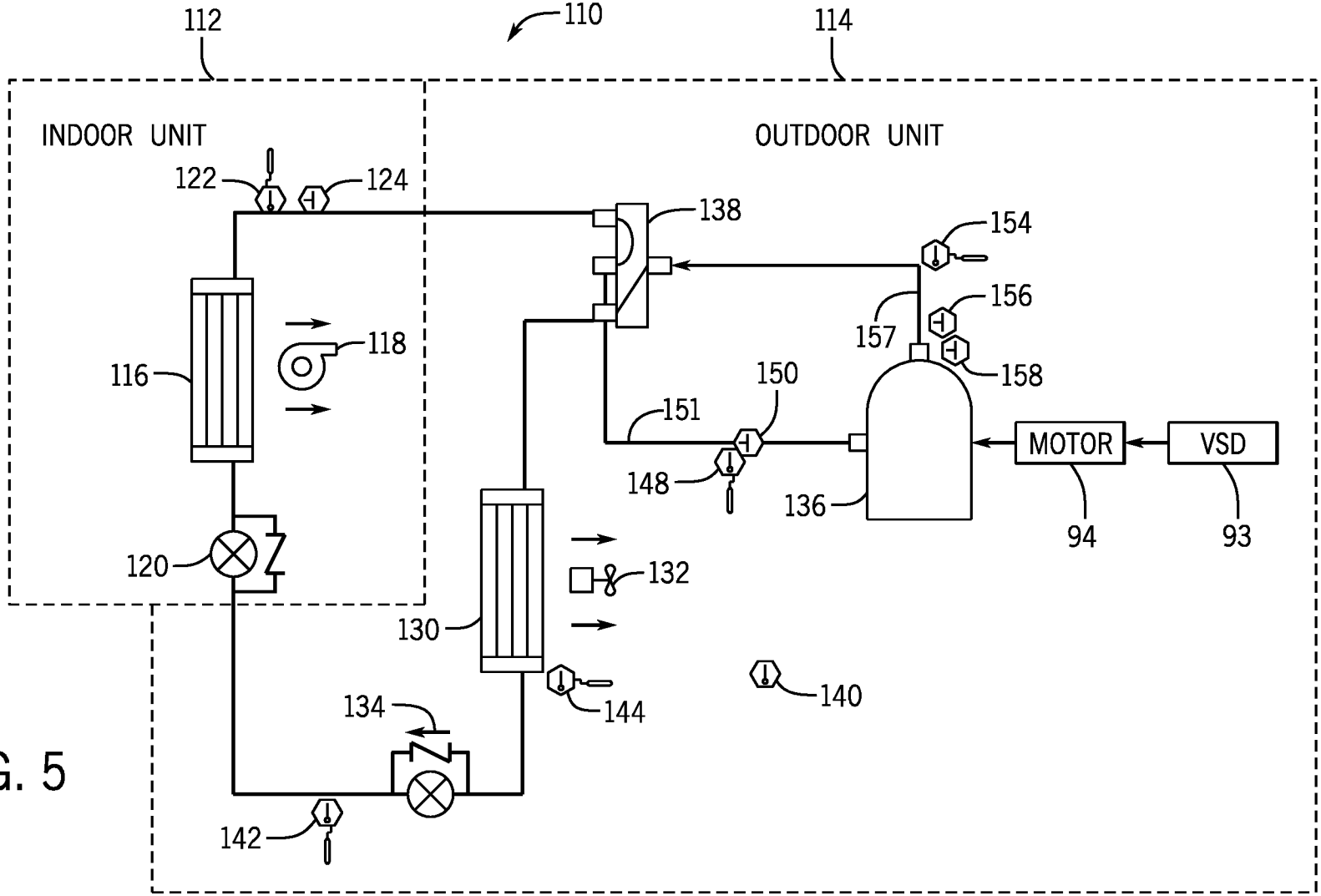
FIG. 5 a schematic diagram of the HVAC system of FIG. 1 that may calibrate a frost temperature difference between an outdoor ambient temperature and a refrigerant temperature to defrost an outdoor refrigerant coil, in accordance with an embodiment of the present disclosure.

To help illustrate, a schematic diagram of a conditioned air system or HVAC system 110, such as the conditioned air system 8 of FIG. 1, that may calibrate a frost temperature difference between an outdoor ambient temperature and a refrigerant temperature to defrost an outdoor refrigerant coil, in accordance with an embodiment of the present disclosure, is shown in FIG. 5. The HVAC system 110 may include conditioned air or HVAC equipment, such as an indoor unit 112 and/or an outdoor unit 114.

As shown in the depicted embodiment, the indoor unit 112 may include an indoor heat exchanger or coil(s) 116 and a blower 118. As described above, the indoor heat exchanger 116, and thus, the indoor unit 112, may act as a condenser when heating a building and as an evaporator when cooling the building. The indoor unit 112 may also include an indoor expansion device or expansion valve 120, for example, selectively bypassed such that refrigerant bypasses the indoor expansion device 120 when the indoor heat exchanger 116 may act as the condenser and flows through the indoor expansion device 120 when the indoor heat exchanger 116 acts as the evaporator.

Moreover, the indoor unit 112 may include a variety of sensors that send information via sensor data or measurement signals to the control panel 82. For example, the indoor unit 112 may include an indoor temperature sensor 122 and an indoor pressure sensor 124. The indoor temperature sensor 122 may measure temperature and the indoor pressure sensor 124 may measure pressure of refrigerant in the indoor unit 112, for example, output from the evaporator.

Additionally, as in the depicted embodiment, the outdoor unit 114 may include an outdoor heat exchanger or coil(s) 130 and a fan 132. As described above, the outdoor heat exchanger 130, and thus, the outdoor unit 114, may act as the evaporator when heating a building and as a condenser when cooling the building. The outdoor unit 114 may also include an outdoor expansion device 134, for example, selectively bypassed such that refrigerant bypasses the output expansion device 134 when the outdoor heat exchanger 130 may act as the evaporator and flows through the outdoor expansion device 134 when the indoor heat exchanger 116 act as the condenser.

As in the depicted embodiment, the outdoor unit 114 may also include a compressor 136 and a four-way valve 138. In particular, the compressor 136 may receive refrigerant via a suction line, compress the refrigerant to increase temperature and/or pressure, and output the refrigerant via a discharge line. Additionally, in some embodiments, the four-way valve 138 may enable selectively operating in an air conditioning mode and a heat pump mode, for example, by controlling whether each of the suction line and the discharge line is coupled to the outdoor heat exchanger 130 or the indoor heat exchanger 116.

Moreover, the outdoor unit 114 may include a variety of sensors that send information via sensor data or measurement signals to the control panel 82. For example, the outdoor unit 114 may include an ambient temperature sensor 140, liquid line temperature sensor 142, an outdoor coil temperature sensor 144, a suction line temperature sensor 148, a suction line pressure sensor 150, a discharge line temperature sensor 154, and a discharge line pressure sensor 156. The outdoor coil temperature sensor 144 may measure temperature of refrigerant in the outdoor heat exchanger 130. Similarly, the compressor sensor 152 may measure operational parameters of the compressor 136, such as actuation speed of the compressor 136 and/or flow rate of refrigerant through the compressor 136. Furthermore, the ambient temperature sensor 140 may measure temperature of environmental air, for example, outside the building 10.

In some embodiments, the suction line temperature sensor 148 may measure temperature of refrigerant within the suction line 151 and the suction line pressure sensor 150 to measure pressure of refrigerant within the suction line 151. Additionally, the discharge line temperature sensor 154 may measure temperature and the discharge line pressure sensor 156 may measure pressure of refrigerant within the discharge line 157. As in the depicted embodiment, the outdoor unit 114 may also include a high pressure switch 158, for example, which transitions to an open position when discharge pressure of the compressor 136 exceeds a threshold to facilitate reducing pressure within the discharge line 157.

Figure 6:
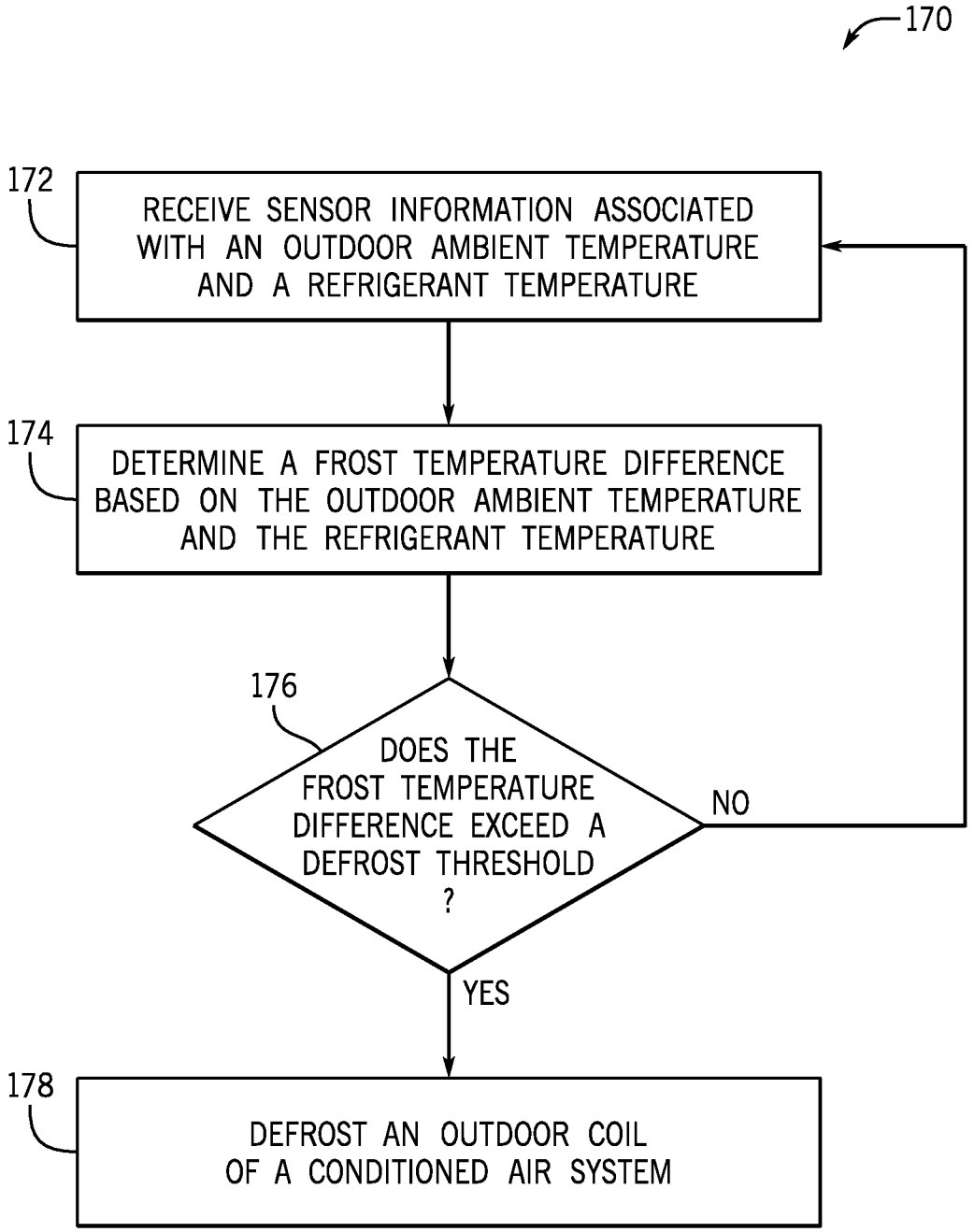
FIG. 6 is a flow diagram of a process for determining when to defrost an outdoor coil of the HVAC system of FIG. 1, in accordance with an embodiment of the present disclosure.

The conditioned air system 8, and more particularly, the processor 86 of the control panel 82, may determine that frost and/or ice has formed on the outdoor coil 130 based on certain information, such as sensor information from a refrigerant temperature or pressure sensor and/or an outdoor ambient temperature sensor. For example, FIG. 6 is a flow diagram of a process 170 for determining when to defrost the outdoor coil 130, in accordance with an embodiment of the present disclosure. While the process 170 is described using steps in a specific sequence, it should be understood that the present disclosure contemplates that the described steps may be performed in different sequences than the sequence illustrated, and certain described steps may be skipped or not performed altogether. In some embodiments, the process 170 may be implemented by executing instructions stored in a tangible, non-transitory, computer-readable medium, such as the non-volatile memory 88, using a processor, such as the processor 86 of the control panel 82.

As illustrated, the processor 86 receives, at process block 172, certain information associated with an outdoor ambient characteristic, such as an outdoor ambient temperature, and a refrigerant characteristic, such as a refrigerant temperature. The certain information may include sensor information or other information that may be used to estimate or derive the outdoor ambient characteristic and the refrigerant characteristic. In particular, the sensor information associated with the outdoor ambient temperature may be provided by the outdoor ambient temperature sensor 140. The sensor information associated with the refrigerant temperature may be provided by a temperature sensor, such as the outdoor coil temperature sensor 144 and/or the suction line temperature sensor 148. In some embodiments, the sensor information associated with the refrigerant characteristic may be a refrigerant pressure, such as refrigerant pressure information provided by a pressure sensor. The pressure sensor may include, for example, the suction line pressure sensor 150. The processor 86 may then derive the refrigerant temperature from the pressure by converting the pressure value to a temperature value using other available data, such as a lookup table. The outdoor ambient temperature and the refrigerant temperature may be correlated, in that the outdoor ambient temperature sensor 140 may detect the outdoor ambient temperature and the outdoor coil temperature sensor 144 may detect the refrigerant temperature at approximately the same time.

At process block 174, the processor 86 then determines a frost temperature difference between the outdoor ambient temperature and the refrigerant temperature. For example, the processor 86 may subtract the refrigerant temperature from the outdoor ambient temperature to obtain the frost temperature difference.

At decision block 176, the processor 86 determines whether the frost temperature difference exceeds a defrost threshold. If the frost temperature difference exceeds the defrost threshold, then, in process block 178, the processor 86 controls the conditioned air system 8 to enter a defrost mode. In particular, the processor 86 may control the conditioned air system 8 to send warm refrigerant to the outdoor coil 130 to melt or thaw out the frost and/or ice formed on the outdoor coil 130. The defrost mode may be similar to the cooling mode, though, in some embodiments the outdoor fan 132 may be inactive or off. In some embodiments, the processor 86 may control the conditioned air system 8 to enter the defrost mode if the frost temperature difference exceeds the defrost threshold for a duration of time, such as two to ten seconds. If the frost temperature difference does not exceed the defrost threshold, then the control board returns to process block 172, as the processor 86 has not determined that frost and/or ice has formed on the outdoor coil 130.

The conditioned air system 8 may remain in the defrost mode until the processor 86 determines the frost and/or ice formed on the outdoor coil 130 has been melted or thawed away. In some embodiments, the processor 86 may determine that the refrigerant temperature has reached a threshold temperature. For example, if the processor 86 receives an indication from the outdoor coil temperature sensor 144 that the refrigerant temperature exceeds the threshold temperature, then the processor 86 may control the conditioned air system 8 to exit the defrost mode. The threshold temperature may be any suitable temperature that indicates there is no longer frost and/or ice formed on the outdoor coil 130, such as above 45° Fahrenheit (F), 50° F., 60° F., and so on. In some embodiments, the processor 86 may control the conditioned air system 8 to exit the defrost mode if the processor 86 receives an indication that the conditioned air system 8 has been set to operate in a cooling mode, or another non-heating mode.

Figure 7:
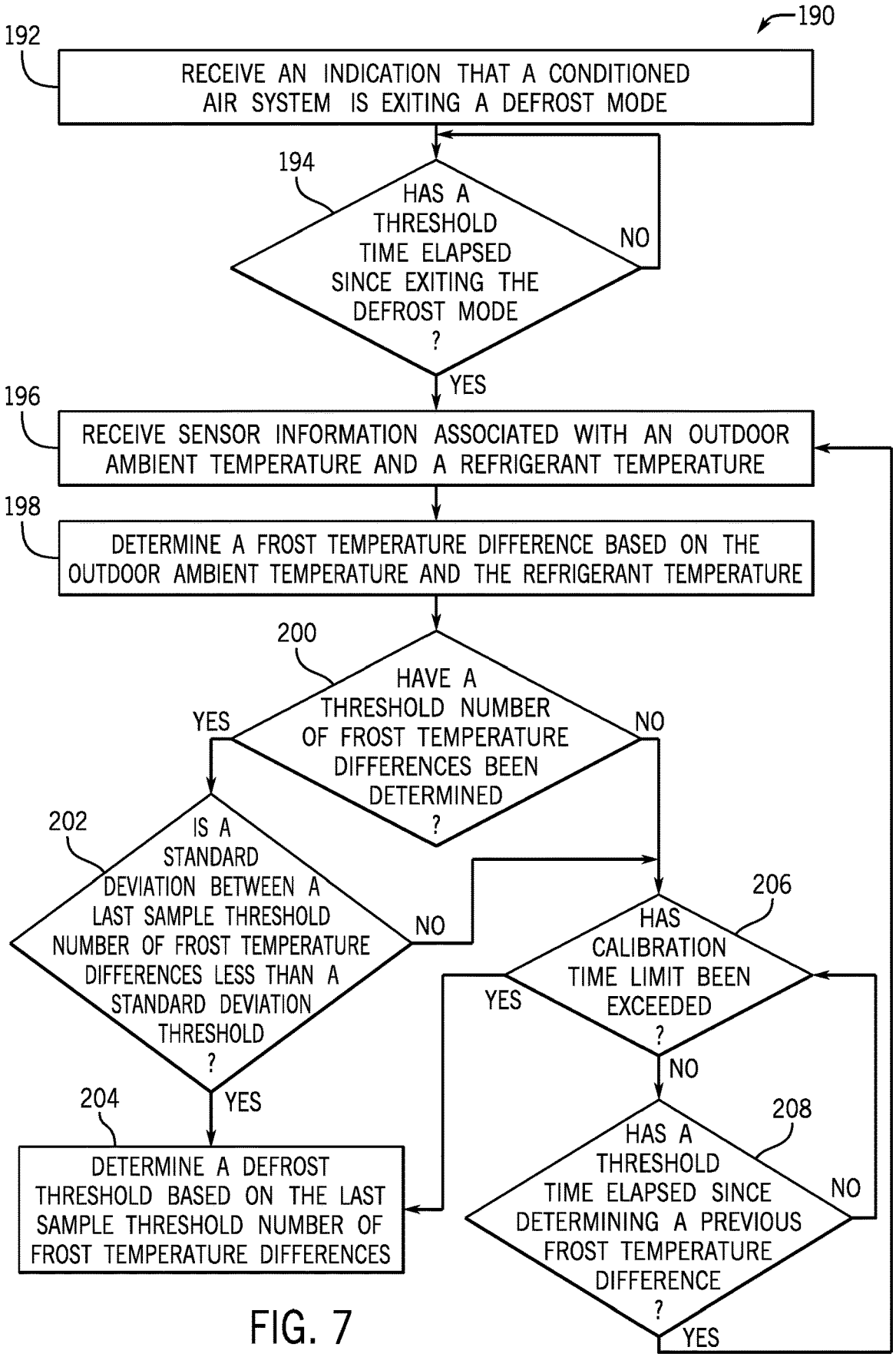
FIG. 7 is a flow diagram of a process for calibrating a defrost threshold, in accordance with an embodiment of the present disclosure.

In some embodiments, the defrost threshold may initially be set to any suitable temperature that may indicate frost and/or ice developing on the outdoor coil 130. After the conditioned air system 8 exits from the defrost mode, and thus enters a normal operating mode such as a heating mode, the processor 86 may calibrate the defrost threshold used to determine whether frost and/or ice has formed on the outdoor coil 130. FIG. 7 is a flow diagram of a process 190 for calibrating the defrost threshold, in accordance with an embodiment of the present disclosure. While the process 190 is described using steps in a specific sequence, it should be understood that the present disclosure contemplates that the described steps may be performed in different sequences than the sequence illustrated, and certain described steps may be skipped or not performed altogether. In some embodiments, the process 190 may be implemented by executing instructions stored in a tangible, non-transitory, computer-readable medium, such as the non-volatile memory 88, using a processor, such as the processor 86.

As illustrated, the processor 86 receives, at process block 192, an indication that the conditioned air system 8 is exiting the defrost mode. The indication may be based on the processor 86 determining the refrigerant temperature has reached a threshold temperature and/or the conditioned air system 8 being set to operate in a cooling mode, or another non-heating mode.

At decision block 194, the processor 86 then determines whether a threshold time has elapsed since exiting the defrost mode. The threshold time may be any suitable time that facilitates ensuring that the conditioned air system 8 is in a more stable condition. For example, the threshold time may be in the range of one to thirty minutes, such as two, three, five, or ten minutes.

If the threshold time has not elapsed since exiting the defrost mode, then the processor 86 returns to decision block 194. If the threshold time has elapsed since exiting the defrost mode, then the processor 86, in process block 196, receives certain information, such as sensor information, associated with an outdoor ambient temperature and a refrigerant temperature. In particular, the sensor information may be provided by the outdoor ambient temperature sensor 140, the outdoor coil temperature sensor 144, the suction line temperature sensor 148, the suction line pressure sensor 150, or any other suitable temperature-related sensor.

At process block 198, the processor 86 then determines a frost temperature difference between the outdoor ambient temperature and the refrigerant temperature. For example, the processor 86 may subtract the refrigerant temperature from the outdoor ambient temperature.

At decision block 200, the processor 86 determines whether a threshold number of frost temperature differences have been determined. The threshold number may be any number of frost temperature differences suitable for determining a frost temperature difference that accurately characterizes when frost and/or ice has been melted away or thawed out from the outdoor coil 130. For example, the threshold number may be between one and twenty, such as three, four, five, or ten frost temperature differences.

If the threshold number of frost temperature differences have been determined, then, in decision block 202, the processor 86 determines whether a standard deviation between a last sample threshold number of frost temperature differences is less than a standard deviation threshold. The standard deviation may be determined by any suitable technique that identifies an amount that the last sample threshold number of frost temperature differences differ or deviate from an average value of frost temperature differences, and the sample threshold number of frost temperature differences may be any number of frost temperature differences suitable for determining a frost temperature difference that provides an accurate standard deviation. For example, Table 1 below illustrates example frost temperature differences and associated standard deviations for a conditioned air system 8 at each minute elapsed after exiting the defrost mode.

TABLE 1

| Time Elapsed (in minutes) | Outdoor Ambient Temperature (° F.) | Outdoor Coil Temperature (° F.) | Frost Temperature Difference (° F.) | Standard Deviation |
|---|---|---|---|---|
| 1 | 18.6 | 19.6 | −0.1 | |
| 2 | 17.7 | 11.9 | 5.8 | |
| 3 | 16.5 | 9.4 | 7.1 | |
| 4 | 15.8 | 12.7 | 3.1 | 3.66 |
| 5 | 15.7 | 14.4 | 1.3 | 2.61 |
| 6 | 15.7 | 13.4 | 2.4 | 2.52 |
| 7 | 15.6 | 13.4 | 2.1 | 0.72 |
| 8 | 15.6 | 13.5 | 2.0 | 0.45 |
| 9 | 16.2 | 14.6 | 1.6 | 0.32 |
| 10 | 16.7 | 14.6 | 2.1 | 0.24 |
| 11 | 17.5 | 15.4 | 2.1 | 0.24 |
| 12 | 17.5 | 14.7 | 2.8 | 0.48 |
| 13 | 16.8 | 14.3 | 2.5 | 0.33 |
| 14 | 16.5 | 14.3 | 2.3 | 0.28 |
| 15 | 16.7 | 14.7 | 2.0 | 0.33 |
| 16 | 16.8 | 14.8 | 2.1 | 0.23 |
| 17 | 16.7 | 13.9 | 2.8 | 0.34 |
| 18 | 16.5 | 12.9 | 3.6 | 0.72 |
| 19 | 16.4 | 13.6 | 3.0 | 0.61 |
| 20 | 16.5 | 14.2 | 2.4 | 0.49 |

The standard deviations are determined by a sample standard deviation technique wherein each standard deviation is the amount that an associated frost temperature difference deviates from an average of a set including the associated frost temperature difference and the three previous frost temperature differences. For example, the standard deviation at seven minutes after exiting the defrost mode, 0.72, is the summation that the frost temperature difference, 2.1° F., differs from the average of the set of the frost temperature difference and the three previous frost temperature differences, 3.1° F., 1.3° F., and 2.3° F.

The standard deviation threshold may be a standard deviation that is suitable to be associated with the conditioned air system 8 operating in a stable condition, such that conditioned air system pressures and temperatures are unstable or still transitioning. For example, the standard deviation threshold may be between 0 and 10.0, 0 and 5.0, 0 and 2.0, 0 and 1.0, or the like. With reference to Table 1, the processor 86 may use a standard deviation threshold of 1.0, and a sample threshold number of frost temperature differences of four. As such, the processor 86 may determine that the standard deviation (e.g., the first standard deviation) between four frost temperature differences that are less than the standard deviation threshold 1.0 is 0.72, which corresponds to the three frost temperature differences 3.1° F., 1.3° F., 2.3° F., and 2.1° F. at four, five, six, and seven minutes after exiting the defrost mode.

If the processor 86 determines that the standard deviation between the last sample threshold number of frost temperature differences are less than the standard deviation threshold, then, in process block 204, the processor 86 determines a defrost threshold based on the last sample threshold number of frost temperature differences. That is, the processor 86 may determine that the defrost threshold used to determine when to enter the defrost mode in process block 178 of FIG. 6 using the last sample threshold number of frost temperature differences. In some embodiments, the processor 86 may generate a relationship, expression, or curve based on the last sample threshold number of frost temperature differences, and the processor 86 may determine the defrost threshold based on the relationship, expression, or curve.

If the processor 86 determines that the standard deviation between the last sample threshold number of frost temperature differences are not less than the standard deviation threshold from decision block 202, or if the processor 86 determines that the threshold number of frost temperature differences have not been determined, then, in decision block 206, the processor 86 determines whether a calibration time limit has been exceeded. The calibration time limit may be any suitable duration of time that calibration should be performed in and that should not be exceeded. For example, the calibration time limit may include any duration of time between ten minutes and five hours, fifteen minutes and two hours, thirty minutes and one hour, and the like, such as twenty minutes.

If the calibration time limit has been exceeded, then, in process block 204, the processor 86 determines the defrost threshold based on the last sample threshold number of frost temperature differences. For example, if the processor 86 did not determine the standard deviation between the last sample threshold number of frost temperature differences to be less than the standard deviation threshold from decision block 202 before the calibration time limit was exceeded, then the processor 86 determines that the defrost threshold based on the last sample threshold number of frost temperature differences, even if the standard deviation between the last sample threshold number of frost temperature differences are not less than the standard deviation threshold.

If the calibration time limit has not been exceeded, then, in decision block 208, the processor 86 determines whether a threshold time has elapsed since determining a previous frost temperature difference. The threshold time for determining each frost temperature difference may be any suitable duration of time, such as between one second and thirty minutes, five second and five minutes, ten seconds and two minutes, and the like, such as one minute. Referring back to Table 1 above, the threshold time is illustrated as one minute. That is, the processor 86 determines a frost temperature difference every minute. Thus, if the threshold time has not elapsed since determining the previous frost temperature difference, the processor 86 returns to decision block 206 to determine whether the calibration time limit has been exceeded. If the threshold time has elapsed since determining the previous frost temperature difference, then the processor returns to process block 196 to determine a new frost temperature difference.

In this manner, the process 190 enables the processor 86 to calibrate a new, more accurate, defrost threshold. Indeed, because the new defrost threshold is based on a stable condition of the conditioned air system 8, the processor 86 may use the new defrost threshold to more accurately determine when frost and/or ice develops on the outdoor coil 130 of the conditioned air system 8, resulting in more efficient and effective operation of the conditioned air system 8. It should be understood that the thresholds discussed in the present disclosure may be preset by, for example, the manufacturer of the processor 86 and/or the conditioned air system 8, be configurable by a service technician and/or a user, or both.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A heating, ventilation, and air conditioning (HVAC) system at least partially located in an ambient environment, wherein the HVAC system comprises:

a coil configured to transmit refrigerant therethrough;

a first sensor configured to detect a refrigerant characteristic in the refrigerant transmitted through the coil;

a second sensor configured to detect an ambient characteristic of the ambient environment; and a controller configured to:

receive a first refrigerant characteristic value and a second refrigerant characteristic value from the first sensor;

receive a first ambient characteristic value and a second ambient characteristic value from the second sensor, wherein the first refrigerant characteristic value is correlated to the first ambient characteristic value and the second refrigerant characteristic value is correlated to the second ambient characteristic value;

determine a first temperature difference value based on the first refrigerant characteristic value and the first ambient characteristic value;

determine a standard deviation based on the first temperature difference value and a set of other refrigerant characteristic values and other ambient characteristic values;

determine a defrost threshold based on the first temperature difference value in response to determining that the standard deviation is less than a standard deviation threshold; and operate the coil in a defrost mode in response to determining that a second temperature difference value based on the second refrigerant characteristic value and the second ambient characteristic value exceeds the defrost threshold.

2. The HVAC system of claim 1, wherein the coil is configured to:

transfer heat from the ambient environment to the refrigerant in a heating mode; and transfer heat from the refrigerant to the ambient environment in the defrost mode.

3. The HVAC system of claim 1, wherein the first sensor comprises a coil temperature sensor configured to detect refrigerant temperature in the coil.

4. The HVAC system of claim 1, comprising a suction line, wherein the first sensor comprises a suction line temperature sensor configured to detect refrigerant temperature in the suction line.

5. The HVAC system of claim 1, comprising a suction line, wherein the first sensor comprises a suction line pressure sensor configured to detect refrigerant pressure in the suction line, wherein the controller is configured to determine refrigerant temperature from the refrigerant pressure.

6. The HVAC system of claim 1, wherein the second sensor comprises an outdoor ambient temperature sensor configured to detect ambient temperature.

7. The HVAC system of claim 1, wherein the controller is configured to determine the first temperature difference value a duration of time after receiving the first refrigerant characteristic value and the first ambient characteristic value.

8. The HVAC of claim 1, wherein the controller is configured to determine whether a threshold number of temperature difference values have been determined, wherein determining the standard deviation based on the first temperature difference value and the set of other refrigerant characteristic values and the other ambient characteristic values occurs in response to the controller determining that the threshold number of temperature difference values have been determined.

9. The HVAC of claim 1, wherein the controller is configured to determine the standard deviation based on the first temperature difference value and a set of other refrigerant characteristic values and other ambient characteristic values by:

determine a threshold number of temperature difference values based on the set of other refrigerant characteristic values and other ambient characteristic values, wherein the threshold number of temperature difference values comprises the first temperature difference value; and determine the standard deviation based on a difference between the first temperature difference value and the threshold number of temperature difference values.

10. The HVAC of claim 1, wherein the controller is configured to:

determine whether a calibration time limit has been exceeded; and determine the defrost threshold in response to determining that the calibration time limit has been exceeded.

11. A controller of a heating, ventilation, and air conditioning (HVAC) system, wherein the controller comprises a memory device and a processor, wherein the memory device comprises instructions for operating the HVAC system, wherein the processor, when executing the instructions, is configured to:

receive a plurality of refrigerant temperatures;

receive a plurality of outdoor ambient temperatures;

determine a plurality of frost temperature differences based on the plurality of refrigerant temperatures and the plurality of outdoor ambient temperatures;

determine a standard deviation based on the plurality of frost temperature differences;

determine a defrost threshold based on the plurality of frost temperature differences in response to determining that the standard deviation is less than a standard deviation threshold; and after determining the defrost threshold, operate the HVAC system in a defrost mode in response to determining that a frost temperature difference exceeds the defrost threshold.

12. The controller of claim 11, wherein the processor is configured to receive an additional refrigerant temperature, receive an additional outdoor ambient temperature and determine an additional frost temperature difference based on the additional refrigerant temperature and the additional outdoor ambient temperature, in response to determining that a threshold number of frost temperature differences have not been determined.

13. The controller of claim 12, wherein the processor is configured to receive the additional refrigerant temperature, receive the additional outdoor ambient temperature, and determine the additional frost temperature difference, in response to determining that a calibration time limit has not been exceeded.

14. The controller of claim 11, wherein the processor is configured to determine the defrost threshold based on a last threshold number of frost temperature differences of the plurality of frost temperature differences in response to determining that a calibration time limit has been exceeded.

15. A method that calibrates an active defrost threshold, wherein a heating, ventilation, and air conditioning (HVAC) system enters a defrost mode in response to a frost temperature difference exceeding the active defrost threshold, wherein the frost temperature difference comprises a difference between a refrigerant temperature and an outdoor ambient temperature, wherein the method comprises:

receiving information associated with the outdoor ambient temperature and the refrigerant temperature;

determining a measured frost temperature difference based on the outdoor ambient temperature and the refrigerant temperature;

determining a standard deviation based on the measured frost temperature difference; and determining the active defrost threshold based on the measured frost temperature difference and the standard deviation.

16. The method of claim 15, comprising receiving an indication that the HVAC system is exiting the defrost mode, wherein receiving the information associated with the outdoor ambient temperature and the refrigerant temperature occurs in response to receiving the indication that the HVAC system is exiting the defrost mode.

17. The method of claim 16, wherein the indication is received based on the refrigerant temperature exceeding a threshold temperature.

18. The method of claim 16, wherein the indication is received based on the HVAC system being set to operate in a cooling mode or another non-heating mode.

19. The method of claim 15, wherein determining the measured frost temperature difference comprises subtracting the refrigerant temperature from the outdoor ambient temperature.

20. The method of claim 15, comprising determining whether a threshold time has elapsed since exiting the defrost mode, wherein receiving the information associated with the outdoor ambient temperature and the refrigerant temperature occurs in response to determining that the threshold time has elapsed since exiting the defrost mode.

* * * * *